US005908356A

United States Patent [19]

Nagamoto

[11] Patent Number: 5,908,356

[45] Date of Patent: Jun. 1, 1999

[54] WOOD GOLF CLUB HEAD

[75] Inventor: Itsushi Nagamoto, Hamamatsu, Japan

[73] Assignee: Yamaha Corporation, Shizuoka, Japan

[21] Appl. No.: 08/892,628

[22] Filed: Jul. 14, 1997

[30] Foreign Application Priority Data

Jul. 15, 1996 [JP] Japan ..... 8-185069

[51] Int. Cl.[6] ..... A63B 53/04; A63B 69/36

[52] U.S. Cl. ..... 473/224; 473/346

[58] Field of Search ..... 473/224, 219, 473/234, 345, 346, 324, 332, 334, 337, 349, 350, 223, 282, 290, 256; 434/252; 446/397, 404, 418, 422

[56] References Cited

U.S. PATENT DOCUMENTS

| | | | |
|---|---|---|---|
| 479,636 | 7/1892 | Droop | 446/422 |
| 1,549,350 | 8/1925 | Deike | 473/234 |
| 3,556,532 | 1/1971 | Ballmer | 473/332 |
| 4,017,083 | 4/1977 | Johnson | 473/238 |
| 4,191,378 | 3/1980 | Morin | 473/224 |
| 4,432,549 | 2/1984 | Zebelean | 473/345 |
| 4,438,931 | 3/1984 | Motomiya | 473/346 |
| 4,840,371 | 6/1989 | Harris | 473/346 |
| 5,000,454 | 3/1991 | Soda | 473/346 |
| 5,056,705 | 10/1991 | Wakita et al. | 473/346 |
| 5,292,129 | 3/1994 | Long | 473/345 |
| 5,718,641 | 2/1998 | Lin | 473/345 |

FOREIGN PATENT DOCUMENTS 61-33970 10/1986 Japan .

OTHER PUBLICATIONS

"Golf Digest", magazine, Feb. 1975 issue, What Irons are best . . . Forged or cast?, pp. 40–41.

*Primary Examiner*—Sebastiano Passaniti
*Attorney, Agent, or Firm*—Koda & Androlia

[57] ABSTRACT

A metal-wood golf club head having a metallic acoustic adjustment member installed on the inside surface of a sole shell part of the head main body. The acoustic adjustment member is installed so as not to be in contact with the face shell part, crown shell part and peripheral wall shell part that form the head main body.

4 Claims, 2 Drawing Sheets

WOOD GOLF CLUB HEAD

BACKGROUND OF THE INVENTION

1. Field of the Invention

The present invention relates to a wood golf club head and more particularly to a metal-wood golf club head which has a hollow shell structure.

2. Prior Art

Recently, wood golf club heads are mostly made of metal and called "metal-wood" heads. Some metal-wood heads have a plurality of reinforcing ribs inside head main bodies which are formed by casting, for example, an aluminum alloy; and other metal-wood heads, such as the one disclosed in Japanese Utility Model Application Publication (Kokoku) No. S61-33970, are formed by press-molding titanium (Ti) or a titanium alloy into a plurality of shell parts and then joining these respective shell parts into an integral unit by welding, etc. with an L-shaped reinforcing member installed inside the head main body.

However, in the metal-wood heads with the reinforcing ribs, the respective reinforcing ribs installed inside the head main body formed by casting an aluminum alloy are continuously formed around the entire circumference of each shell part, i. e., a face shell part, a crown shell part, a peripheral shell part and a sole shell part; thus, the ribs are to reinforce particularly the face shell part and crown shell part. On the other hand, the L-shaped reinforcing member is customarily installed in the head main body which is formed by molding titanium (Ti) or a titanium alloy into a plurality of shell parts by press molding and then joining these shell parts into an integral unit by welding, etc.; and such an L-shaped reinforcing member is provided between the back surface of the face shell part and the inside surface of the sole shell part; thus, the L-shaped reinforcing member is to reinforce the weld between the face shell part and sole shell part.

As a result, in the respective metal-wood heads described above, the acoustic effect obtained when the ball is hit is suppressed by the reinforcing ribs and the L-shaped reinforcing member; as a result, the club is inferior in terms of the ball-striking sound and the feel of striking the ball. They do not give the impression of a "good-hit".

SUMMARY OF THE INVENTION

Accordingly, the object of the present invention is to provide a metal-wood golf club head that has a good acoustic effect when a ball is hit, thus improving the ball-hitting sound and the feel of hitting the ball.

The object of the present invention is accomplished by a unique structure for a metal-wood golf club head in which a head main body that has a hollow shell structure consisting of a face shell part, a crown shell part, a peripheral wall shell part and a sole shell part is formed by a process in which plate-form light metal elements are formed into a plurality of three-dimensionally curvilinear shell parts by press molding, and these shell parts are joined into an integral unit, wherein an acoustic adjustment member is installed on the inside surface of the sole shell part of the head main body in a state in which the acoustic adjustment member is separated or isolated from the face shell part, crown shell part and peripheral shell part. The acoustic adjustment member is a plate-form member or a rod-form member and is installed along a ball striking direction of the head main body.

DETAILED DESCRIPTION OF THE INVENTION

Figure 1:
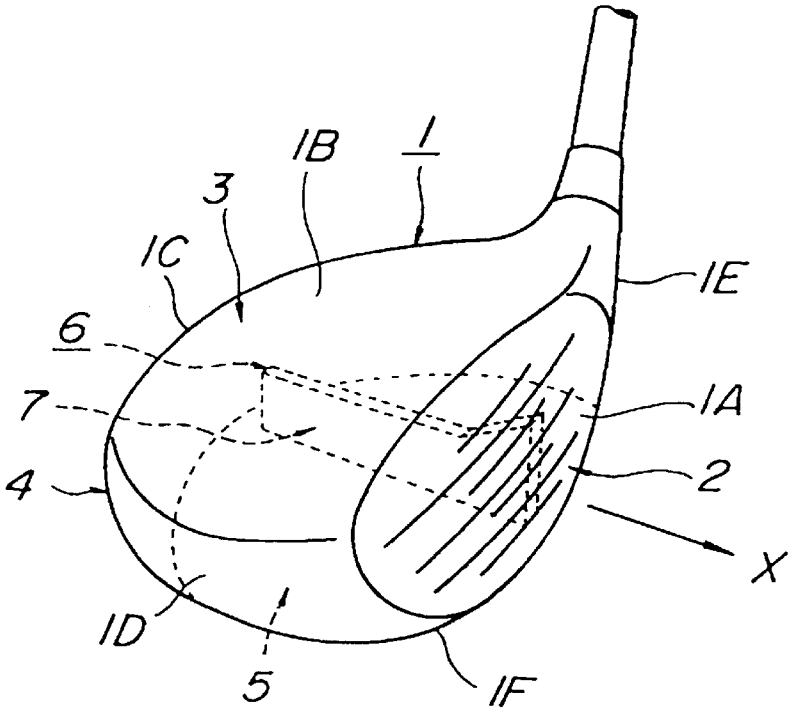
FIG. 1 illustrates one embodiment of the metal-wood golf club head according to the present invention.
Figure 2:
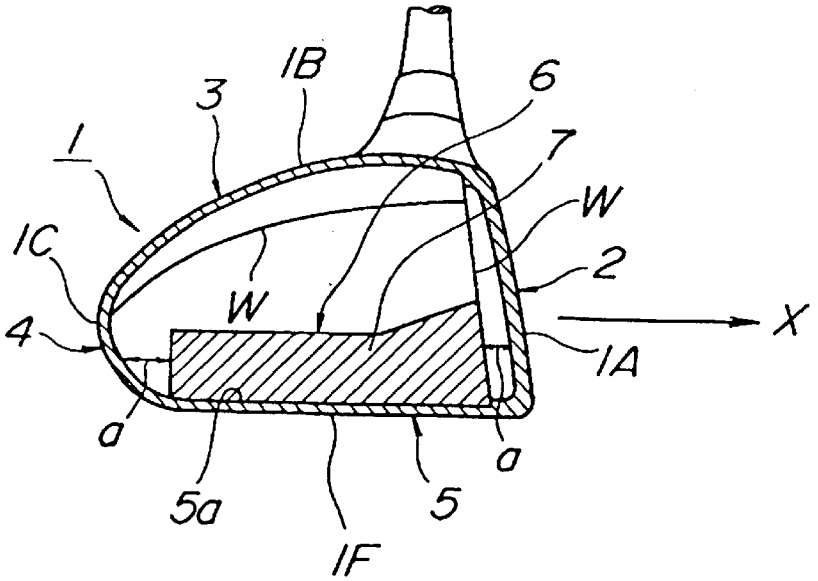
FIG. 2 is a longitudinal sectional view thereof.
Figure 3:
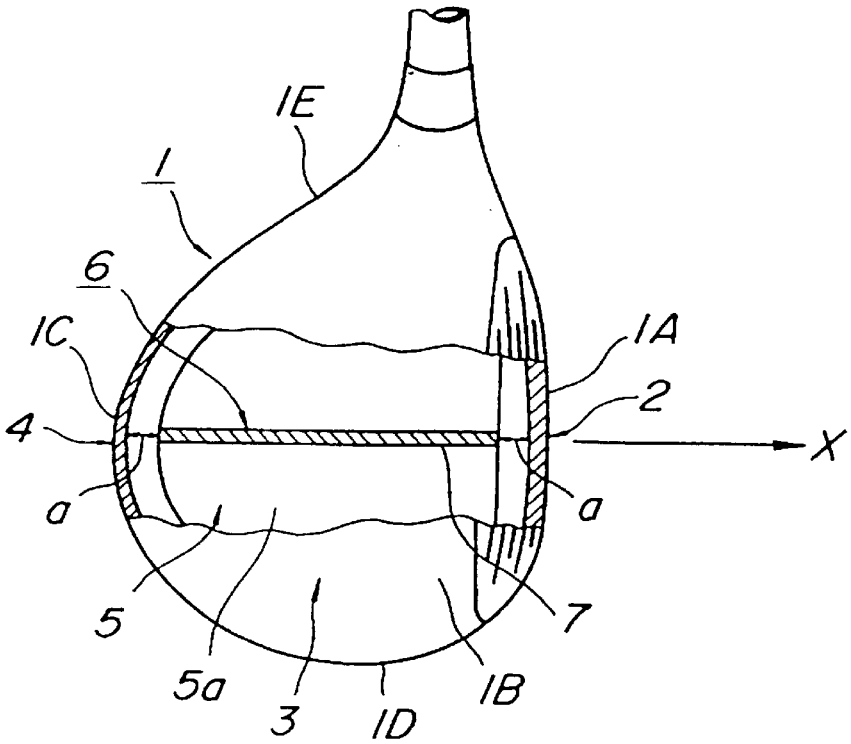
FIG. 3 is a partially cut-away sectional top view thereof.

As shown in FIGS. 1 through 3, a head main body 1 consists of a hollow shell structure.

More specifically, the head main body 1 is comprised of three (3) parts: a face shell part 2 which forms a relatively thick face surface 1A, a crown shell part 3 which forms a relatively thin crown surface 1B, and a sole shell part 5 which forms a substantially planar sole surface 1F. The sole shell part 5 includes a peripheral wall shell 4 which comprises a back wall surface 1C, a toe side wall surface 1D and a heel side wall surface 1E (The peripheral wall shell 4 can be a separate piece from the sole surface 1F). Each of these three (3) parts are obtained by press-molding plate-form light metal elements made of titanium (Ti) or a titanium alloy, and they are joined into an integral unit by welding so as to form a three-dimensionally curvilinear shape. In FIG. 2, W represents lines of the welded edges of the shell parts.

Figure 4:
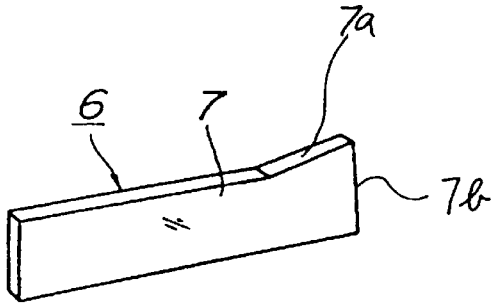
FIG. 4 is a perspective view of the acoustic adjustment member used therein.

An acoustic adjustment member referred to by the reference numeral 6 is installed inside the thus obtained head main body 1. As shown in FIG. 4, the acoustic adjustment member 6 in this embodiment is a plate-form member 7 and has an inclined top edge 7*a* so that the front end edge 7*b* that is located near the face surface 1A (when the member 7 is installed) is higher than the other portions of the plate-form member 7. The plate-form member 7 is installed, as best seen in FIGS. 1 and 2, by welding, etc. on the central portion of the inner surface 5*a* of the sole shell part 5 so as to stand upright and extend along the ball-striking direction X or in the direction substantially at right angles relative to the face surface 1A. In addition, the plate-form member 7 is not in contact with the face shell part 2, crown shell part 3 and peripheral wall shell part 4 with gaps a, thus being separated from these shell parts.

The plate-form member 7 used as the acoustic adjustment member 6 is obtained from the same material as the shell parts of the head main body 1, i. e., titanium (Ti) or a titanium alloy, etc. The thickness of the plate-form member 7 is 1 to 3 mm, preferably 1.5 to 2.5 mm; and the height of the plate-from member 7 is 5 to 30 mm, preferably 10 to 20 mm. In addition, the gaps a between the plate-form member 7 and the face shell part 2 and peripheral wall shell part 4 are set to be 3 to 10 mm, preferably 5 to 8 mm. As shown in FIG. 2, the upper edge of the plate-form member 7 is not in contact with the crown shell part 1B. The plate-form member 7 described above has the inclined edge surface 7*a*; however, a plate-form member that has parallel upper and lower edges with no inclined edge surface can indeed be used instead.

Figure 5A:
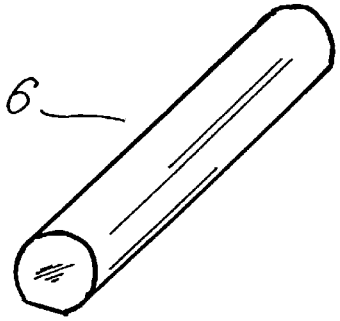
FIGS. 5(*a*) and 5(*b*) are perspective views of the acoustic adjustment members of other types.
Figure 5B:
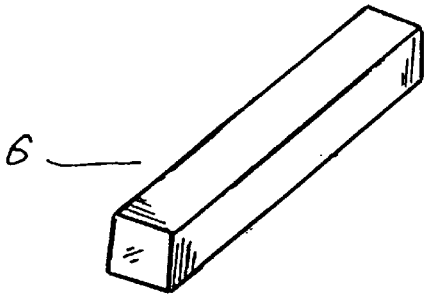

In addition, the acoustic adjustment member 6 can be a rod-form member, such as a round rod as shown in FIG. 5(*a*) or square rod as shown in FIG. 5(*b*), etc, unlike the flat-plate member described above.

As seen from the above, in the present invention, as a result of the employment of the construction described above, an acoustic adjustment member 6 is installed on the inside surface 5*a* of the sole shell part 5 of the head main body 1, and this acoustic adjustment member 6 is installed so as not to be in contact with the face shell part 2, crown shell part 3 or peripheral wall shell part 4 by a preferable distance. Accordingly, although the vibration of the sole shell part 5 during the striking of the ball is suppressed by the acoustic adjustment member 6, the vibration of the face shell part 2, crown shell part 3 and peripheral wall shell part 4 does not influence the acoustic adjustment member 6, thus generating a good ball striking sound. In addition, the frequency of the ball-striking sound and the volume of such sound can be changed by using acoustic adjustment members of different lengths and shapes, thus increasing the acoustic effect of the club head hitting the ball.

Furthermore, the position of the center of gravity of the head can easily be changed by using acoustic adjustment members of different weight.

As is clear from the above, according to the present invention, an acoustic adjustment member is installed on the inside surface of the sole shell part of a metal-wood head so as not to be in contact with the face shell part, crown shell part and peripheral wall shell part. Accordingly, even though the vibration of the sole shell part is suppressed by the acoustic adjustment member, the acoustic adjustment member has no effect on the vibration of the face shell part, crown shell part and peripheral wall shell part. As a result, the frequency of the ball-striking sound and the quantity of such sound can be adjusted by varying the length and shape of the acoustic adjustment member, thus increasing the acoustic effect of the club upon impact with a ball. In addition, the club head of the present invention improves the ball-striking sound and the feel of striking the ball, so that the impression of a "good-hit" can be obtained.

In addition, the center of gravity of the club head can easily be adjusted by using an acoustic adjustment member of a different weight-, thus making it possible to provide a low center of gravity in the club head.

I claim:

1. A wood golf club head in which a head main body having a hollow shell structure consisting of a face shell part, a crown shell part, and a sole shell part is formed of plates comprising light metal elements into a plurality of three-dimensionally curvilinear shell parts by press molding and then joining said shell parts into an integral unit, said sole shell part forming a substantially planar sole surface wherein:

a plate-shaped acoustic adjustment member is installed on an inside surface of said sole shell part of said head main body in a state in which said acoustic adjustment member is separated from said face shell part, crown shell part and peripheral shell part and is installed along a direction perpendicular to a striking surface of said face shell part; and a gap is provided between end of said plate-shaped acoustic adjustment member and said face shell part.

2. A wood golf club head according to claim 1, wherein said sole shell part includes a peripheral wall shell comprising a back wall surface, a toe side wall surface and a heel side wall surface.

3. A metal-wood golf club head having a hollow interior formed by a plurality of shell parts including at least a face shell part and a sole shell part said sole shell part forming a substantially planar sole surface, said club head being provided with an acoustic metal member of a plate shape securely fixed on an inside surface of said sole shell pat so as to extend generally upright at right angles relative to said face shell part with a gap between an end of said metal member and said face shell part.

4. A metal-wood golf club head provided therein with a plate-shaped acoustic metal member standing upright on an inside surface of a sole of said club head and extending in a direction at right angles relative to a face of said club head said sole comprising a substantially planer sole surface, said plate-shaped metal member being installed with gaps between said plate-shaped acoustic metal member and a surrounding metal shell which forms said club head with one of said gaps being between an end of said plate-shaped acoustic metal member and said face of said surrounding metal shell.

* * * * *